United States Patent [19]

Shenoha

[11] 4,231,290

[45] Nov. 4, 1980

[54] MULTIPLE HEAD MARKING DEVICE

[75] Inventor: James L. Shenoha, Lockport, Ill.

[73] Assignee: Norwood Marking & Equipment Co., Downers Grove, Ill.

[21] Appl. No.: 955,706

[22] Filed: Oct. 30, 1978

[51] Int. Cl.[3] ..... B41J 1/08

[52] U.S. Cl. ..... 101/93.11; 101/93.37; 101/336; 400/224

[58] Field of Search ..... 101/93.01, 93.11, 93.37, 101/93.38, 93.39, 103, 332, 336; 400/82, 213, 224, 229, 232; 219/216

[56] References Cited

U.S. PATENT DOCUMENTS

| | | | |
|---|---|---|---|
| 1,031,541 | 7/1912 | Duncan | 400/224 |
| 2,202,958 | 6/1940 | McFarland | 400/224 X |
| 2,485,254 | 10/1949 | Brewster | 101/336 |
| 2,734,615 | 2/1956 | Wallendael | 400/224 |
| 3,331,320 | 7/1967 | Young et al. | 101/336 X |
| 3,346,090 | 10/1967 | Goff, Jr. et al. | 400/232 |
| 3,595,362 | 7/1971 | Wolowitz | 400/229 X |
| 3,720,954 | 3/1973 | Czyryk | 346/106 |
| 3,910,396 | 10/1975 | Eischen et al. | 400/82 |

FOREIGN PATENT DOCUMENTS

| | | | |
|---|---|---|---|
| 2214793 | 9/1973 | Fed. Rep. of Germany | 101/336 |

OTHER PUBLICATIONS

"Angled Ribbon Guide", IBM Tech. Discl. Bulletin, vol. 19, No. 10, Mar. 1977, pp. 3817–3818.

"Dual Element Typewriter", IBM Tech. Discl. Bulletin, vol. 13, No. 7, Dec. 1970, pp. 1765–1766.

"Print Ribbon", IBM Tech. Discl. Bulletin, vol. 21, No. 1, Jun. 1978, pp. 19–20.

*Primary Examiner*—Eugene H. Eickholt

*Attorney, Agent, or Firm*—Hill, Van Santen, Steadman, Chiara & Simpson

[57] ABSTRACT

A multiple imprint transfer tape marking device, which will imprint a multiplicity of imprint surfaces, substantially simultaneously.

The imprint marking device includes a plurality of laterally aligned, individually powered marker heads which are adjustably positioned for cyclically imprinting a packaging film movable along an imprint path, normal to the laterally aligned marking heads. The imprint marking device further provides a transfer tape assembly pivotally adjustable to a suitable angle relative to the aligned marker heads to provide a proportioned width of the tape for individual use by each of the marker heads. The tape assembly is provided with an automatic tape advance mechanism and is arranged to accept various width transfer tapes selected in accordance with the number of marker heads utilized and the size of the imprint indicia.

7 Claims, 11 Drawing Figures

IV
IV
20
22
23
24
25
26
28
30
32
34
36
38
40
42
46
48
50
54
56
57
60
64
66
68
69
70
82
84
86
88

MULTIPLE HEAD MARKING DEVICE

BACKGROUND OF THE INVENTION

1. Field of the Invention

This invention relates to a marking apparatus for use with transfer tape and more particularly to a multiple imprint marking apparatus having individually powered marker heads which are adjustably positioned to imprint a variety of packaging films.

2. Prior Art

Most present day marking equipment used to imprint packaging films or the like with current information, such as date coding or pricing, provide machines which utilizes a transfer tape in which pigmentation is transferred to an imprinting surface by means of pressure and/or heat. While such tape provides an excellent imprint, it has the disadvantage in that once an area of the tape has been used for imprint, the pigmentation is removed and this area may not be reused. Accordingly, after each imprint cycle the tape must be advanced to provide a fresh new area for each subsequent impression that is to be made.

Machines using this tape provide a marker head which is supported in a frame for reciprocative movement relative to an imprint surface whereby a printing block, equipped with raised indicia, strikes the tape to apply the imprint to the imprint surface, positioned immediately adjacent the transfer tape in synchronism with a stop and go movement of the imprint surface. The marker head, which often includes a heating block is attached to a carriage for reciprocative movement along a pair of guides supported on the frame. The carriage is usually moved by means of an actuator slide having a curved cam slot therein with operative engagement with a follower carried by the carriage. Thus, as the slide is moved back and forth by means of a fluid cylinder the cam slot and follower are effective to impart the imprint motion to the marker head. While these devices have been extremely successful, they are not readily adaptable to provide multiple impressions as is desirable when sheet packaging material is utilized providing a series of side-by-side packaging film areas. Heretofore a pair of independent marking devices have been utilized each of which are supported and operable independently of the other. This arrangement has not been entirely satisfactory because of excessive costs, space requirements and complex mounting and control arrangements needed.

Attempts have been made to produce simultaneous impressions on packing film with the use of a single unit providing a pair of marker heads carried on a common carriage and actuated by a single power means. These devices however, have proved difficult to adjust and to position the heads when working with varying width packaging films resulting in poor impressions and often faulty register of the imprint on the generally limited size imprint area frequently provided. Further, since the transfer tape must provide independent tracks for each marker head, it proved necessary to skew the entire marking apparatus relative to the path of travel of the packaging film, which further complicates the registering adjustment of the marker heads to "square" the indicia with the film. Slight misalignment or faulty adjustment will accordingly produce a defective impression which is exceedingly serious since these marking devices apply important last minute information such as pricing, dating or other coding to a packaged product.

Further, when more than two side-by-side film packaging areas are utilized with a roll of packaging film, proper adjustment and positioning of the marker heads to provide good register and uniform impression density is virtually unattainable.

It would therefore be a decided advance in the state of the art to provide a fully adjustable multiple head imprinting device utilizing a transfer tape to imprint various side-by-side packaging areas generally simultaneously along a length of a packaging film.

SUMMARY OF THE INVENTION

My invention overcomes the disadvantages and difficulties associated with the prior art and provides such an adjustable multiple head imprinting device which produces a plurality of aligned imprints to be made on a product film movable past the marking device prior to a packaging operation. This is accomplished with independently powered marker heads which are fully and easily adjustable for producing unusually clear imprints in designated areas along the product film with independent adjustment of the transfer tape assembly to provide discrete sections or width portions of the tape for use by each of the marker heads without tape waste or overlapping.

The marker heads are adjustably positioned along a support frame in a laterally aligned orientation relative to one another and extending perpendicular to a packaging film which is movable along an imprint path through the imprint device. Two, three or more marker heads may be utilized and mounted on the frame in suitable spaced relationships relative to one another to multiply imprint certain aligned, predesignated imprint locations along the width of the packaging film. Each of the independently powered marker heads, being "square" with the product film is easily adjusted to provide a perfect imprint at each imprint location. The marker heads are each individually powered by a compact, short stroke fluid cylinder which is connected directly to a movable imprint member.

The multiple imprinter further provides an adjustable transfer tape assembly which accepts various width transfer tapes, selected in accordance with the number of marking heads utilized and with the size of the indicia required. Herein, the entire transfer tape assembly is pivotably adjusted on the imprint device relative to the marker heads whereby an individual width portion of the tape is made available to each of the marker heads without waste or "strike overs."

It is therefore a general object of this invention to provide a multiple imprint marking device for use with transfer tape which is adapted for use with a wide variety of packaging films.

It is more specific object of this invention to provide independent power actuation for each of a plurality of marker heads with individual adjustment provided therefor to produce sharp clear impressions on a packaging film at predesignated aligned imprint areas.

It is another object of this invention to provide a multiple imprinting device having a plurality of laterally aligned, individually powered marker heads which are positioned for cyclically imprinting a packaging film movable along an imprint path, normal to the laterally aligned marker heads.

It is another more specific object of this invention to provide multiple imprinting device for use with transfer tape in which the transfer tape is pivotably adjustable relative to a plurality of laterally aligned marker heads to provide individual width portions of the transfer tape for each of the marker heads.

Other objects,, features and advantages of the invention will be readily apparent from the following description of several embodiments thereof, taken in conjunction with the accompanying drawings although variations and modifications may be effected without departing from the spirit and scope of the noval concepts of the disclosure.

DESCRIPTION OF THE PREFERRED EMBODIMENTS

Figures 1, 2:
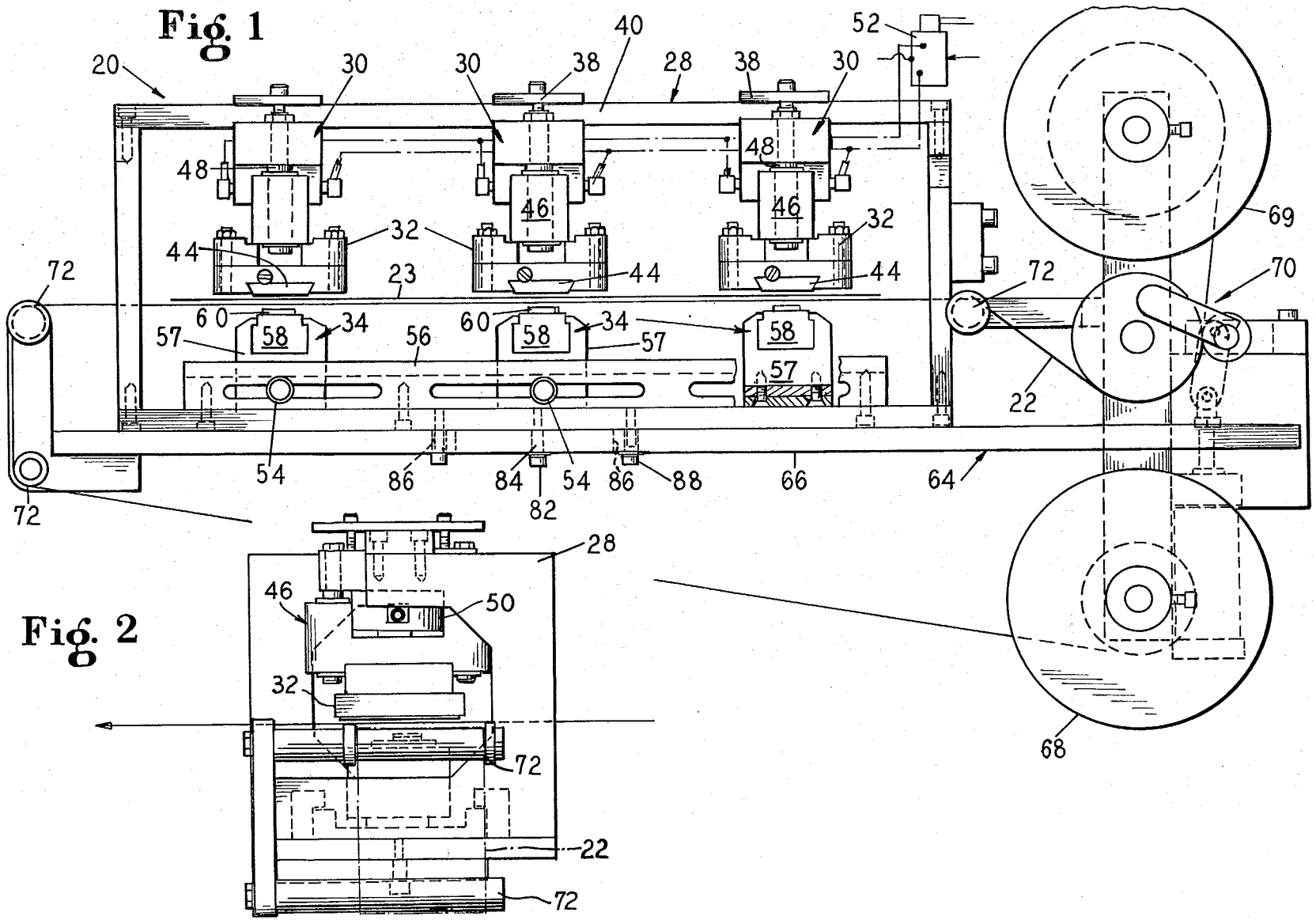
FIG. 1 is a side elevational view of a multiple imprinting device constructed in accordance with the principles of this invention.
FIG. 2 is an end elevational view of the imprinting device of FIG. 1.
Figures 3, 4, 5:
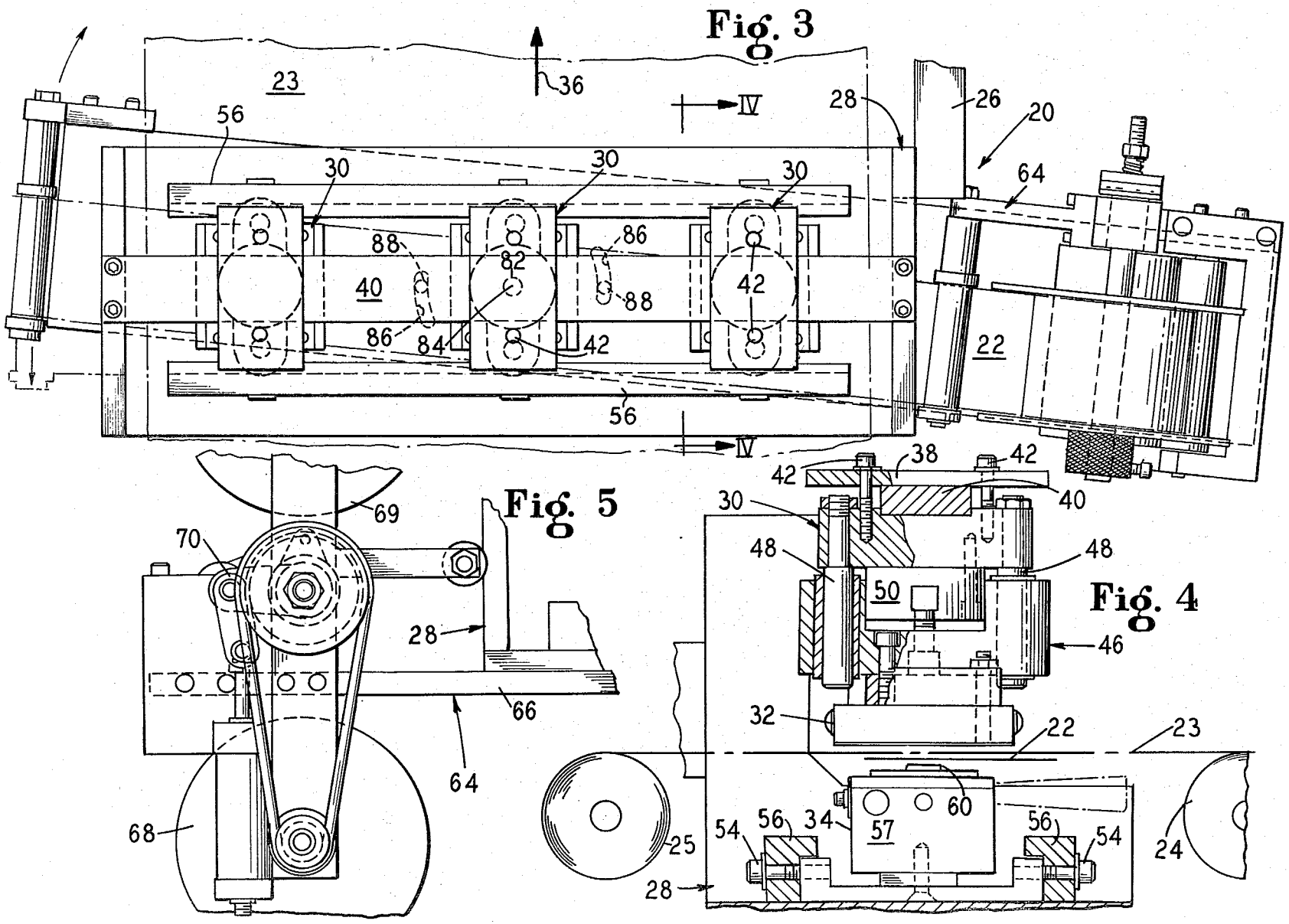
FIG. 3 is a top plan view of the imprinting device of FIG. 1.
FIG. 4 is a sectional view taken generally along the line IV—IV of FIG. 3.
FIG. 5 is a fragmentary elevational view of the transfer tape advance mechanism.

As shown in FIG. 1, 20 generally designates a multiple imprint marking device for use with a transfer tape 22 which is positioned for use to mark a film 23 utilized in a packaging operation. The packaging film 23 is diagrammatically shown in FIG. 4 as moving from a supply reel 24 to a take-up reel 25 in a stop and go movement as is conventionally provided in packaging operation, through the marking device 20. As will be readily apparent to those skilled in the art of the particular details of the packaging operation are of no importance to this invention since the invention is equally utilizable in a wide variety of embodiments for marking items other than rolls of film, such as, for example, bags, boxes, or strip material and the like. Generally, the multiple marking device 20 of this invention is useful wherever a flow of articles to be imprinted can be brought to move past a working station and wherein it is desiraable to simultaneously imprint a plurality of aligned and spaced apart marks as best seen in FIG. 3. A support arm 26 is provided to position the marking device 20 relative to the packaging film 23 for imprinting predetermined groups of imprint areas, spaced transversely across the width of the packaging film 23.

As best seen in FIGS. 1 and 3, the multiple imprint marking device comprises an elongated frame 28 which is attached to the support arm 26 and which extends laterally across the width of the film 23. The frame 28 provides a mount for adjustably supporting a plurality of marking head assemblies 30 in alignment relative to one another and being perpendicular to the packaging film path of movement designated by arrow 36 in FIG. 3. Each of the marking head assemblies 30 include a powered striker 32 and a marking head 34 which are independently adjustable on the elongated frame 28 to position each of the marking head assemblies 30 at a predesignated location relative to the packaging film 23 in order to simultaneously imprint the series of aligned imprint areas in synchronism with the stop and go movement of the film 23 associated with the packaging operation.

Each of the powered strikers 32 includes a clamping assembly 38 fixedly securable along a guide rail 40 of the elongated frame 28 by means of position locking screws 42 and includes a reciprocable anvil 44 carried by a carriage 46 guidably supported on a pair of guide pins 48 downwardly extending from the clamping assembly 38. A double acting short stroke power cylinders 50, supported by the clamping assembly 38 is provided to reciprocably strike the anvil 44 when actuated against a related marker head 34 with the film 23 and transfer tape 22 interposed therebetween.

A control valve 52, shown diagrammatically in FIG. 1, is appropriately activated by a suitable signal generated relative to the packaging operation (not detailed) to control the reciprocable movements of the powered strikers 32.

The marker heads 34 which are each independently adjustable to coincide with relative imprint areas on the packaging film 23 as best seen in FIG. 4, are secured in position between a pair of spaced guide rails 56 extending across the lower portion of the elongated frame 28, by means of clamping screws 54. The guide rails 56 insure that each of the marker heads 34 is held "square" relative to the packaging film 23 and provides an accurate yet simple adjustment to exactly position the marker heads 34. The marker heads 34 normally include a heated block 57 and a removable printing block member 58 having raised indicia 60 providing the required imprint information formed thereon. The raised indicia 60 which upon heating by the block 57 and striking the tape 22 will transfer pigmentation from the tape to the imprint areas associated with each discrete packaging portion of the film 23. Since the film is generally preprinted and only limited specific locations are allocated on each of the packaging portions of the film, it becomes obvious why adjustability and positioning of the indicia becomes so important to a successful packaging operation in which last minute information must be imprinted on each packaging portion of the film 23.

While the anvils 44 are shown as carried by the powered strikers 32 and the raised indicia 60 are positioned relative thereto on the elongated frame 28, in some instances it may be advantageous to reverse the position of these elements.

Figure 6:
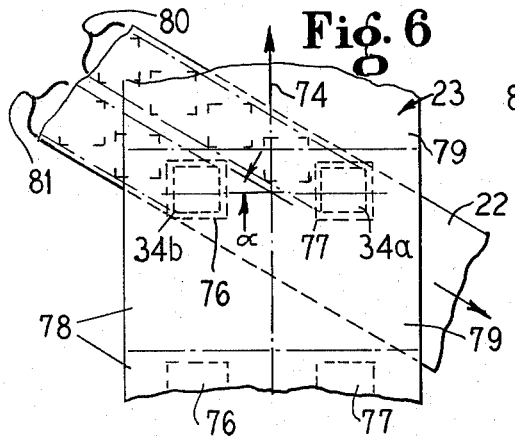
FIGS. 6–11 are diagrammatic illustrations of various embodiments of the present invention showing the adjustment of the transfer tape in relationship to the number, spacing and indicia size of the marker heads of this invention.

As illustrated in FIGS. 1 and 3, the imprint marking device 20 includes a transfer tape assembly 64 for positioning and advancing the tape 22 in a prescribed manner. The transfer tape assembly 64 comprises a transfer tape frame 66 which is pivotally attached to the elongated frame 28 for angular adjustment relative thereto and which in turn rotatably supports a transfer tape supply reel 68 and a take-up reel 69 and a tape advance mechanism 70. Further, a series of guide rollers 72 are provided on the transfer tape assembly 64 to direct a span of the transfer tape 22 between the printing block member 58 and the anvil 44 for generally angled lateral movement relative to the packaging film 23 which is advanced in stop and go movements by suitable mechanism (not detailed) which is provided for use in connection with a product packaging operation. The tape advance mechanism 70 may be of any convenient design which may be adjusted to provide a suitable tape area for use by proportional sized indicia 60 as may be required. Thus, as best seen in FIG. 6 of the drawings the packing film 23 is advanced in the direction of the arrow 74, to provide a full measure of film for the packing operation and is effective to spot imprint areas 76, 77 at positions in register with the marker heads 34. In the FIG. 6, embodiment the packaging film 23 comprises a length of film with a series of side-by-side packaging areas 78, 79 extending therealong. Herein, an individual width portion 80 of the transfer type 22 is provided for use by the marker head 34*a* and a width portion 81 is provided for use by the market head 34*b*.

To provide these individual width portions 80 and 81, it will be seen that the path of tape movement is angled relative to the marker heads 34*a* and 34*b* by adjusting the position of the transfer tape assembly 64. The transfer tape frame 66 is pivotally carried by the elongated frame 28 on a shoulder bolt 82 or the like for adjustable movement about an axis 84. A pair of curved guide slots 86 are provided in the frame 66 with clamping screws 88 extending therethrough and threaded into the elongated frame 28 to provide means of locking the transfer tape assembly 64 and accordingly the transfer tape at a desired angle.

Figure 7:
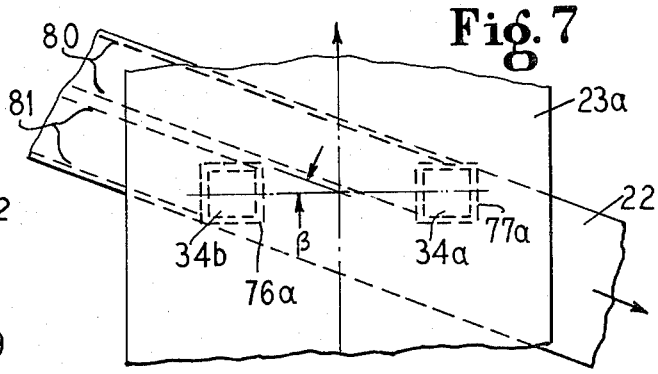
Figure 8:
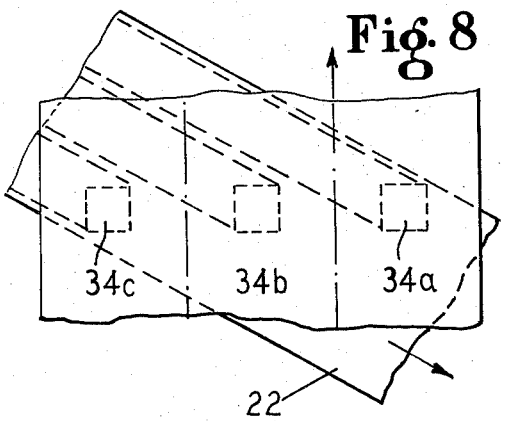
Figure 9:
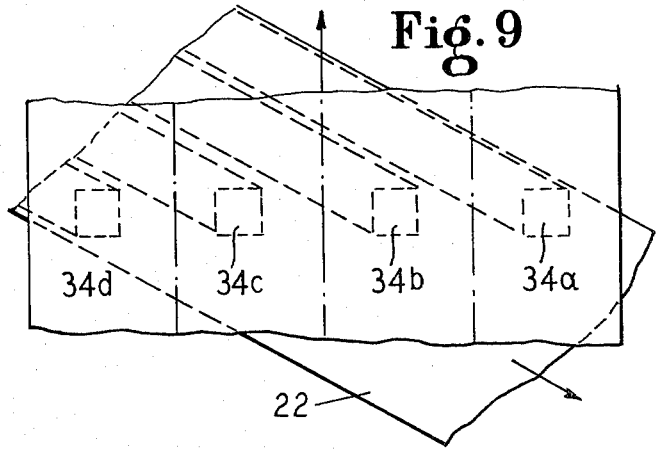

The adjusted angle of the tape 22 is determined primarily by the spacing between marker heads 34*a* and 34*b*. Thus, when the marker heads are moved apart to be placed in register with imprint areas 76*a* and 77*a* of a wide packaging film 23*a* as shown in FIG. 7, the tape angle $\beta$ is adjustably decreased from the greater tape angle $\alpha$ required in the FIG. 6 embodiment to provide the full width portions 80 and 81. Further, it will be evident from the embodiments shown diagrammatically in FIGS. 8, 9 and 10 that an increase in the number or size of marker heads utilized in a packaging operation will necessitate the use of a wider transfer tape and require adjustment of the tape advancing means 70 to deliver a compatible tape area for use by the marker heads to provide suitable individual width portions, while changing the spacing between marker heads requires only that the tape angle be adjusted.

Figure 10:
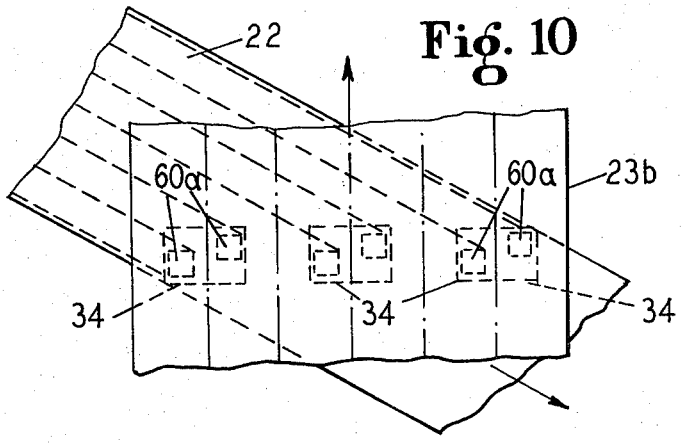

When imprints are to be applied to the film at close spacing, for example, as shown in FIG. 10, and the imprint areas on packaging film 23*b* are comparatively large, a pair of indicia areas 60*a* may be provided with each of the marking heads 34 in a somewhat offset aligned relationship to minimize the tape angle.

Figure 11:
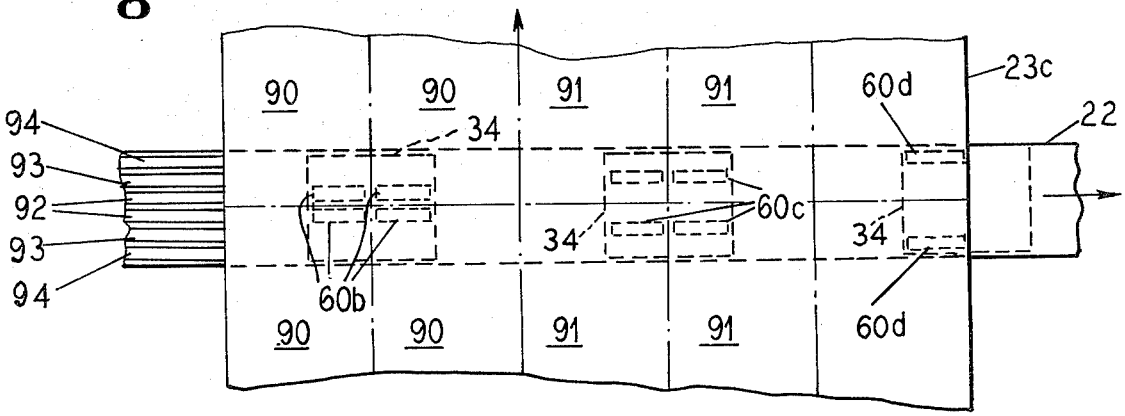

Further, in certain packing operations in which the imprint areas provided on packaging film 23*c* are comparatively large and arranged in end-to-end relationship as well as being side-by-side, two pairs of indicia areas 60*b* are provided on a single marker head 34 to imprint four adjacent packaging areas 90 simultaneously with additional pairs of indicia areas 60*c* carried by adjoining marker heads 34. The additional pairs of indicias 60*c* are shown in FIG. 11 as spaced apart longitudinally and arranged to imprint four more adjacent packaging areas 91 with any more required indicias spaced still further apart on their marker heads 34. In this embodiment, the path of the tape 22 is adjusted to a parallel, laterally aligned orientation relative to the marker heads with the offset spacing between the indicia on adjacent marker heads providing individual width portions of transfer tape for each indicia. Accordingly, the width portions or bands 92 are used by the indicia 60*b*; bands 93 are used by indicia 60*c* and bands 94 are provided when indicia 60*d* is required. Obviously, in this embodiment, the tape angle relative to the aligned marker heads 34 is set at 0°.

Thus, it will be recognized that the relationship of the tape angle relative to the aligned marker heads 34 enables the multiple imprint marking device 20 to be used in a wide range of applications and having a high degree of flexibility in operation.

I claim as my invention:

1. A multiple imprinting apparatus for simultaneously marking a plurality of discrete marking areas on a surface to be marked, said marking areas being spaced apart transversely of a line of travel of the surface to be marked, comprising an imprint marking assembly having a frame member mounted in juxtaposition to the surface to be marked, a plurality of transversely spaced marker head members adjustably carried on said frame member for positioning said marker head members in registration with said discrete marking areas, said marking areas being variable in size and spacing when changing the surface to be marked, each marker head member includes an individually powered striker member, movable towards and away from the marking areas, a transfer tape assembly including a transfer tape, carried by said frame member, means to adjust said transfer tape assembly to angularly position a span of the transfer tape relative to the transversely spaced marker head members for movement therealong, said span having a longitudinal length and a width, the marker head members having raised imprinting indicia thereon in opposition to said tape whereby the angular adjustment of said transfer tape assembly is effective to position said transfer tape span relative to said raised indicia whereby each raised indicia contacts the tape span to imprint the discrete marking areas when striker members are activated, in a discrete longitudinal area of the tape, said longitudinal areas being offset from one another across the width of the tape and non-overlapping.

2. The apparatus according to claim 1, wherein said transfer tape assembly includes a tape advancing means and guide means for said tape span, being adjustable to deliver an unused portion of each longitudinal area into imprint registration with one of said raised indicia preceding each imprint.

3. In an imprint marker having a marking stations at which raised indicia are brought into contact with an imprint transfer tape for use in imprinting a series of spaced aligned side-by-side imprint areas spaced along a packaging film, the improvement comprising a series of spaced apart raised indicia positioned adjacent the packaging film, means to individually and substantially simultaneously impart an imprint motion to said series of raised indicia and means to adjust the series of indicia to positions in register with said series of imprint areas, a transfer tape span passing between said series of raised indicia and said packaging film, and means to angularly adjust the tape span relative to said series of raised indicia whereby each raised indicia is effective to imprint said series of aligned side-by-side imprint areas while utilizing a discrete longitudinal portion of the transfer tape being offset from one another across the tape width and being non-overlapping.

4. A multiple imprinting apparatus for imprinting a plurality of discrete marking areas on a surface to be marked, the surface being movable along a path of travel past the apparatus, the discrete marking areas being spaced apart and aligned normal to the path of travel, comprising: an elongated frame member positioned in juxtaposition to the surface to be marked, a plurality of transversely spaced marking head assemblies adjustably positioned along said elongated frame member in registration with said discrete marking areas, each marking head assembly carrying an imprint indicia thereon, an individual power means associated with each of said plurality of aligned marking head assemblies to provide an imprint motion therefor, a transfer tape assembly including a transfer tape, carried by said elongated frame, means to adjust said transfer tape assembly to angularly position a span of the transfer tape relative to the transversely spaced marking head assemblies to provide a proportioned width of transfer tape for individual use by each of the imprint indicia, and a tape advance means to automatically advance the transfer tape to provide a discrete portion of said span of tape for use by each imprint indicia with each impression made.

5. The apparatus according to claim 4, wherein imprint surface areas comprise a discrete marking area of limited size arranged in side-by-side relationship along a length of packaging film, and said plurality of marking head assemblies each include an individual striker member being movable toward and away from said packaging film by said individual power means and being adjustable along an upper guide rail of said elongated frame to position individual striker members in registration with each of said discrete marking areas, each said marking head assemblies further including a marker head with said imprint indicia carried thereon and being adjustable along a lower guide means for positioning in vertical spaced alignment with said striker members, said packaging film and said span of tape passing therebetween, wherein each imprint indicia contacts the tape in a discrete longitudinal area of the span of tape, said longitudinal areas being offset from one another across the width of said span and non-overlapping.

6. The apparatus according to claim 5, wherein said transfer tape assembly further includes means to accommodate use of tapes differing in width to provide said discrete portions of said span when changing the number or size of said imprint indicia utilized.

7. The method of imprinting a plurality of discrete imprint areas along a length of packaging film, said packaging film being advanced longitudinally along a path of travel past an imprint transfer tape marking device and having a series of imprint areas arranged across the packaging film width in longitudinally aligned pairs for simultaneously imprinting said series of imprint areas comprising the steps of adjusting a plurality of transversely disposed marker heads of the marking device to positions whereby each of said marker heads is placed in alignment with one of said aligned pairs of imprint areas and normal to the path of travel, locating a pair of indicia on each marker head in longitudinal spaced relationship relative to one another along the path of travel, with the indicia on each successive marker head being spaced apart an increased increment in an amount at least equal to an overall dimension of a preceding pair of longitudinally spaced indicia, positioning a transfer tape for movement past said marker heads and parallel thereto in which each indicia contacts the transfer tape in a different area across the transfer tape width and non-overlapping, advancing the packaging film longitudinally to bring a series of imprint areas into imprint position relative to said marker heads, and advancing the transfer tape transversely to bring an unused portion of said transfer tape into imprint position relative to said indicias.

* * * * *